US009879510B2

(12) United States Patent
Lisk

(10) Patent No.: US 9,879,510 B2
(45) **Date of Patent: *Jan. 30, 2018**

(54) PUMP AND CONTROL SYSTEM FOR DISTRIBUTING FLUID

(71) Applicant: Mike Lisk, Cloudcroft, NM (US)

(72) Inventor: Mike Lisk, Cloudcroft, NM (US)

( * ) Notice: Subject to any disclaimer, the term of this patent is extended or adjusted under 35 U.S.C. 154(b) by 696 days.

This patent is subject to a terminal disclaimer.

(21) Appl. No.: 14/473,206

(22) Filed: Aug. 29, 2014

(65) Prior Publication Data

US 2015/0354326 A1 Dec. 10, 2015

Related U.S. Application Data

(63) Continuation-in-part of application No. 13/167,328, filed on Jun. 23, 2011, now Pat. No. 8,820,404.

(60) Provisional application No. 61/572,302, filed on Jun. 23, 2010.

(51) Int. Cl.

| | |
|---|---|
| ***E21B 43/12*** | (2006.01) |
| ***F04D 13/10*** | (2006.01) |
| ***F04D 15/00*** | (2006.01) |
| ***F04D 15/02*** | (2006.01) |

(52) U.S. Cl.

CPC ..... *E21B 43/128* (2013.01); *F04D 13/10* (2013.01); *F04D 15/0088* (2013.01); *F04D 15/0209* (2013.01)

(58) Field of Classification Search

CPC .... E21B 43/128; E21B 43/12; F04D 15/0209; F04D 13/10; F04D 15/0088

See application file for complete search history.

(56) References Cited

U.S. PATENT DOCUMENTS

| | | | | |
|---|---|---|---|---|
| 1,035,431 | A | 8/1912 | Ericson | |
| 1,632,188 | A | 6/1927 | Loeber | |
| 2,286,613 | A * | 6/1942 | Fuller | F04D 9/06 137/211.5 |

(Continued)

FOREIGN PATENT DOCUMENTS

| | | |
|---|---|---|
| JP | 9-189303 | 7/1997 |
| JP | 2001-193140 | 7/2001 |

(Continued)

OTHER PUBLICATIONS

International Search Report and Written Opinion for PCT/US2015/046753 dated Nov. 27, 2015.

(Continued)

*Primary Examiner* — Yong-Suk Ro

(74) *Attorney, Agent, or Firm* — Womble Bond Dickinson (US) LLP

(57) ABSTRACT

A pump and control system for distributing a fluid from a source location to one or more remote locations. At least one of the remote locations can be at an elevation higher than that of the source location. The system may have a power source, a controller, and one or more fluid storage vessels. The system also may have a distribution piping and one or more monitoring devices to sense fluid pressure corresponding to fluid fill levels in the one or more fluid storage vessels. The system additionally can have a pump that automatically provides fluid to the one or more fluid storage vessels at the remote locations through the distribution piping.

22 Claims, 10 Drawing Sheets

(56) References Cited

U.S. PATENT DOCUMENTS

| | | | | |
|---|---|---|---|---|
| 2,990,780 | A * | 7/1961 | Kreuter | F04D 15/0083 318/481 |
| 3,148,622 | A * | 9/1964 | Le Ambrose | F04D 13/16 318/484 |
| 3,299,111 | A * | 1/1967 | Adams | C07C 11/21 554/224 |
| 3,705,626 | A * | 12/1972 | Glenn, Jr. | E21B 43/12 166/250.15 |
| 3,937,599 | A | 2/1976 | Thureau et al. | |
| 3,963,374 | A | 6/1976 | Sullivan | |
| 4,166,713 | A * | 9/1979 | Debrey | G05D 9/12 417/36 |
| 4,180,374 | A | 12/1979 | Bristow | |
| 4,329,120 | A * | 5/1982 | Walters | F04B 49/022 417/12 |
| 4,744,334 | A | 5/1988 | McAnally | |
| 4,744,344 | A | 5/1988 | Morozumi | |
| 4,874,294 | A | 10/1989 | Karg | |
| 5,197,859 | A * | 3/1993 | Siff | F04B 49/022 417/19 |
| 5,667,362 | A | 9/1997 | Murai et al. | |
| 5,718,269 | A | 2/1998 | McGarvey | |
| 6,264,431 | B1 * | 7/2001 | Triezenberg | F04D 13/08 417/19 |
| 6,382,225 | B1 * | 5/2002 | Tipton | B60K 15/00 123/514 |
| 6,699,019 | B2 | 3/2004 | Myers et al. | |
| 8,008,796 | B2 | 8/2011 | Muchow | |
| 8,457,798 | B2 | 6/2013 | Hackett | |
| 8,664,903 | B2 * | 3/2014 | Northup | H02P 23/08 318/400.02 |
| 8,760,089 | B2 * | 6/2014 | Smith | F04B 49/06 318/244 |
| 2006/0112478 | A1 | 6/2006 | Kolar | |
| 2009/0107562 | A1 * | 4/2009 | Wang | E03B 11/06 137/357 |
| 2011/0140435 | A1 | 6/2011 | Miller | |
| 2012/0325460 | A1 | 12/2012 | Lisk | |

FOREIGN PATENT DOCUMENTS

| | | | |
|---|---|---|---|
| JP | 2004-092387 | A | 3/2004 |
| JP | 2004-108253 | | 4/2004 |
| JP | 2010-48020 | | 3/2010 |
| KR | 20-2010-0004835 | | 5/2010 |
| WO | WO 01-21429 | A1 | 3/2001 |
| WO | WO 2008/025362 | A1 | 3/2008 |

OTHER PUBLICATIONS

International Search Report and Written Opinion for PCT/US2012/054617 dated Mar. 8, 2013.

International Search Report and Written Opinion for PCT/US2011/041694 dated Feb. 21, 2012.

Solar-Powered Livestock Watering Systems, National Center for Appropriate Technology, Energy Brief, http://www.zomeworks.com/wp-content/uploads/2012/03/solarpumping.pdf, Mar. 2012, 4 pages.

Morris et al., Solar-Powered Livestock Watering Systems, ATTRA, http://www.attra.ncat.org/attra-pub/solarlswater.html, Oct. 2002, 8 pages.

Buschermohle, Solar-Powered Livestock Watering Systems, Agricultural Extension Service, The University of Tennessee, PB1640-1M-1/00 E12-2015-00-151-00, 15 pages.

Solar-Powered Livestock Watering Systems, National Center for Appropriate Technology, Energy Brief, 4 pages.

* cited by examiner

PUMP AND CONTROL SYSTEM FOR DISTRIBUTING FLUID

CROSS REFERENCE TO RELATED APPLICATION

The present application is a continuation-in-part of U.S. Nonprovisional patent application Ser. No. 13/167,328, filed Jun. 23, 2011, which claims priority and benefit to Provisional Patent Application 61/572,302 (which was originally filed as U.S. Nonprovisional patent application Ser. No. 12/822,077, on Jun. 23, 2010, but which was converted to Provisional Patent Application 61/572,302 by Request Under 37 C.F.R. 1.53(c)(2) For Conversion of a Utility application to a Provisional application on Jun. 22, 2011).

BACKGROUND OF THE INVENTION

Water production on remote wells for livestock and other applications has long been problematic. Water production of remote wells for the livestock industry typically has several problems such as low production rates of solar pumping systems on deep wells, failure rates and associated maintenance costs, and additional challenged with windmill water production systems including access and waste. Many within the industry have resorted to using generators which can require repeated trips to a remote well site to fuel and start a generator to pump enough water to satisfy livestock water consumption needs.

Solar power can be an effective answer, but presents its own challenges. With solar powered water pumping systems, flow rates on deep water wells are typically very low when compared to the flow rates of a standard deep well pump supported by AC electrical power. Solar energy production is dependent on exposure to sunlight. Water production capabilities will be decreased or can cease in times of decreased or no sunlight. In some cases, the water production rate of a solar water production system is the primary limiting factor restricting a livestock property to realize its full potential. Additionally, as long as there is sunlight the pump will continue to operate after the distant storage tank is full. The water that is pumped will overflow from the tank onto the ground. This condition will continue as long as there is sunshine unless an operator travels to the pump location and turns the pump off. In arid areas of the world a good deal of the water that is spilled onto the ground is absorbed into the atmosphere and lost. The remaining water seeps back into the ground, but can take several years to reach static ground water levels and charge the ground water supply.

Windmill water production is also a common solution to water production issues on remote water well sites. Typically, windmills are very wasteful when producing water. Unless turned off by an operator, windmills pump as long as wind is present. Once the storage vessel is full, excess water generally spills out onto the ground wasting the water and the operating efforts of the windmill Windmills also tend to be expensive and difficult to maintain, often involving risky and hazardous conditions to the technician performing maintenance.

The maintenance of windmill water production systems also can be very expensive and dangerous to the operator and technicians. Typical frequent maintenance tasks are replacement of the seals at the bottom of the well piping requiring the expense of several man hours and the use of a crane type vehicle. Servicing the gear box assembly at the top of the windmill pumping system tower requires a technician to climb high up to the top of the windmill tower or be raised to the area by some lifting device so that lubrication, oil change maintenance and repairs to that portion can be performed. This exposes a technician to the hazards of working in conditions at heights with tools, lubricants, and being subject to wind gusts that can create an extremely dangerous environment.

The point of use generator, though often the least expensive up front, can overall be a very expensive approach to water production. A generator typically requires an operator making a trip to the site with a container of fuel, fueling the generator, and then starting it along with the deep well pump in the well. Typically, the operator does not wait the several hours that it takes the generator to consume the fuel, but leaves the site understanding that when the generator has consumed all of the fuel, it will stop running Allowing the generator to run out of fuel under an electrical load in this manner is extremely hazardous to both the generator and the deep well pump, often shortening the operating life of each piece. This practice further can lead to expensive repairs or early replacements of either the generator or the well pump.

The livestock industry in particular has long been challenged by a need for and a lack of efficient solutions to water distribution over elevations on grazing lands, especially in arid and dry regions around the world. Where water can be distributed across grazing lands to targeted locations near feeding areas, the water will be utilized more efficiently by the livestock. Livestock that must travel long distances to watering locations such as troughs naturally will collect in greater herds to make the trip from the feeding location to the watering location. Large herds of livestock arriving to drink at the same time result in a high demand on the water in the troughs and storage tanks.

Pipe lines are often installed to deliver water across a landscape to supply water to areas supporting livestock. Commonly the source of water, usually a well, storage pond or tank, is located at a lower elevation than the location where the water is needed. When this is the case a water delivery technology such as a pump is required to pump the water to the higher elevations where one or more storage tanks and/or troughs are located. In an off-grid setting, one solution is using a solar powered pump to pump water by solar energy to higher elevation distant storage tanks. The solar powered pump will pump water, from the well, pond or a local storage tank to the distant storage tank filling the storage vessel for livestock use.

U.S. Pat. Nos. 4,744,334 and 1,632,188 and 6,699,019 describe methods and apparatus for the pumping and transfer of ground water to the surface for livestock consumption needs. The invention disclosed in U.S. Pat. No. 4,744,334 generally suffers from a limited water production capability as compared to the invention of the well pumping and control systems water production capabilities. The windmill water pumping inventions disclosed in U.S. Pat. Nos. 1,632,188 and 6,699,019 suffer in areas of accessibility for maintenance operational dependability cost of repairs and water conservation when compared to the well pumping and control system of the present invention.

While a few devices are available to control pump operation based on the water level in a local storage tank where the well or pump are in close proximity to such storage tank, there is a need for water level control devices to control pump operation based on water levels in distant storage tanks often several miles from the pump location. See, for example, the system detailed in U.S. Pat. No. 8,457,798.

SUMMARY OF THE INVENTION

Incorporation by Reference

The entirety of the disclosures, including specification and drawings, of U.S. Nonprovisional patent application Ser. No. 13/167,328, filed on Jun. 23, 2011, and Provisional Patent Application 61/572,302, filed on Jun. 23, 2010 (which was originally filed on Jun. 23, 2010 as a nonprovisional, but was later converted to provisional application 61/572,302), and U.S. Nonprovisional patent application Ser. No. 13/334,803, filed on Dec. 22, 2011, are specifically incorporated herein by reference as if set forth in their entirety.

DESCRIPTION OF THE INVENTION

In one aspect, the present disclosure relates to an improved well pump and controller system which can monitor various attributes, such as a water pressure, storage water, or other attributes, of the system. The system can be suitable for providing electric power to a pump. Aspects of the invention may be suitable for applications such as remote water wells such as livestock wells where utility power may not be available. As will be described, the present invention is capable of controlling water pumping processes automatically without requiring an on-site operator.

In another aspect, the present invention addresses the problems of prior systems by eliminating over-pumping of countless gallons of ground water. Distribution of water according to the present system will result in greater pasture efficiency, less intense livestock water consumption and the ability to utilize pasture areas that are either underutilized or not used by livestock due to their distance from water.

Water distribution systems using elevation to create water pressure for distribution to lower elevations are known. In rural settings, however, the source of water, e.g. well heads, ponds, etc., are usually not situated at optimal elevation for such distribution. The present invention provides an economical and efficient system for delivering water or other fluids to a higher elevation storage tank at a significantly greater distance from the fluid source than have previously been achieved in conventional ranching practice in order to permit much greater range of controlled distribution to and from that higher elevation storage tank to one or more remote locations.

The present invention can prevent waste of ground water, reduce fuel consumption and emissions due to the repeated trips to well sites and/or due to an unmanned generator, increase water production as needed for livestock, convert formerly unusable areas to usable pastures, and reduce operating costs, benefitting both the natural environment and user.

In another aspect, the present invention is directed to an automatic pump controller and system designed and capable of preventing overflows at distant storage tanks. The system can include a distribution pump controller, sometimes referred to herein as a "system controller" or simply as a "controller," one or more monitoring devices which may include a pressure sensing device, a float switch, a solar array or other power source, water distribution piping, at least one water storage tank or vessel, and a pump, such as a well pump, deep well pump, submersible deep well pump, or the like, that provides water to the water storage vessel along with custom software and an assembly of electrical components and hardware assembled in an enclosure, which may be a NEMA rated enclosure to protect the components from the elements.

The controller can be compatible with solar, DC and/or AC power sources and/or pump motors. However, it will be apparent to one of ordinary skill in the art that the system could be adapted for use with other types of power sources such as propane, combustion engines, other motors, or the like without departing from the scope of this disclosure.

According to a preferred embodiment, the power source includes a solar array. In case night time operation is needed when solar power is unavailable, the controller may be battery powered or capable of operation on an AC electrical source such as an electric generator, utility power, or other power source. In one example, if AC power operation is desired, the controller can be equipped with a cord and plug that can be plugged into an electric generator. The controller will then be supported by AC power and will perform the same functions as when the controller is supported by solar power.

According to a preferred embodiment, the power source includes a generator, such as propane or other generator. In such embodiments, the controller may be capable of starting and stopping the generator.

According to a preferred embodiment, the controller can be adapted to monitor water pressure that is developed on the water distribution piping and storage tank water level. When the water level in a distant storage tank decreases, a slight drop in water pressure can be detected in the water piping even from several miles away. This drop in pressure can be monitored by the system's pressure sensing device. The pressure sensing device can include, for example, a switch or pressure transducer.

When the pressure drops to the preset pressure set point, an electrical signal can be sent to the system controller. In a preferred embodiment, this low pressure signal should be continuous for a preset time to confirm the level in the tank is actually low and not a result of wind moving the water in a sloshing motion. Once the preset time has elapsed without any interruption of the low pressure signal from the pressure switch or pressure transducer, the system's microprocessor can turn on the pump for a preset time. The pump can deliver water to the distant storage tank for a preset time. Once the time has expired, the pump can shut off automatically. As water is used or consumed, the process can repeat.

The present disclosure contemplates and includes, in certain embodiments of the invention, continuously monitoring the water level in the storage vessel with monitoring devices. The present disclosure also includes field sensors to monitor critical operating and environmental conditions. The controller may be capable of analyzing the conditions to control system operation and to prevent hazards to both pump and power source. Embodiments may further include the capability of alerting of the existence of a system issue needing to be addressed, such as providing, for example, maintenance or troubleshooting messages or system status. The alert or notification can be displayed on an LCD screen at a control panel, or can be relayed to a location remote from the system, such as a text message, e-mail or other notification sent to an operator.

In some embodiments, the monitoring devices can include devices for monitoring one or more of a water level in the one of more water storage vessel, a flow rate of the pump, and operating conditions of a power source. The monitoring device can be a float switch or a pressure sensing device, such as a switch or pressure transducer.

In embodiments including a generator, the monitoring device can operate to relay the water level in the water storage vessel to the system control and start the generator and the pump when the water level reaches a preset low level. The system control can monitor the generator and the well pump to protect against operation under low flow conditions or operation of the generator or pump during unsuitable operating parameters. If the system shuts down, a troubleshooting message indicating any reasons for shutdown can be provided.

It is therefore an object of this present invention to provide a well pumping and control system which will significantly enhance water production capabilities at remote well sites.

It is another object of this present invention to provide a well pumping and control system which will significantly enhance the reliability of water production at a remote well site.

It is a further object of this present invention to provide a well pumping and control system which can conserve ground water resources, improve power efficiency, and reduce the undesirable emissions from vehicular traffic to a well site and from unmanned generators.

It is a still another object of this present invention to provide a well pumping and control system which reduces or eliminates health and safety hazards associated with technicians performing maintenance tasks on a windmill water production system at remote locations.

It is a still another object of this present invention to provide a well pumping and control system which can provide a long life, cheap and dependable water production system for remote well sites using a domestically produced, environmentally friendly energy source.

In one aspect, the present invention provides a well pumping and control system that includes an electric generator, a system control, a water storage vessel, a well pump that provides water to the water storage vessel, and a monitoring device for monitoring a water level in the water storage vessel, a flow rate of the pump, and operating conditions of the generator. The monitoring device operates to relay the water level in the water storage vessel to the system control and starts the generator and the well pump when the water level reaches a preset low level. The system control monitors the generator and the well pump to protect against operation under low flow conditions or operation of the generator or pump during unsuitable operating parameters. If the system shuts down, a troubleshooting message indicating any reasons for shutdown is provided. The monitoring device can be a float switch or a water pressure switch. The system can further include a means for monitoring pump discharge flow.

The system can further include at least one of (1) means for monitoring a fuel level and means for displaying a low fuel message, (2) means for monitoring an oil level and means for displaying a low oil message, (3) means for monitoring ambient temperature and means for displaying a low ambient temperature message, (4) means for monitoring a typical fill time of the storage vessel by monitoring the water flow rate from the pump, the quantity of water required to raise the water level to the high level, or the time lapsed between start and stop of the pump, or (5) means for monitoring electrical output from the generator. The system control can cease operation of the pump and generator at an occurrence of one of the following: (1) after the fuel level reaches a preset low fuel level, (2) after the oil level reaches a preset oil low level, (3) after the ambient temperature reaches a preset low ambient temperature, (4) after the typical fill time has lapsed without the monitoring device indicating the water level in the water vessel has reached the high level, or (5) after an indication that the electrical output from the generator is outside a preset electrical output range. The system control can relay an error message at the occurrence of one of the following: (1) after the fuel level reaches a preset low fuel level, indicating the generator requires fuel, (2) after the oil level reaches a preset oil low level, indicating the generator requires oil (3) after the ambient temperature reaches a preset low ambient temperature, indicating the generator and pump should not be run (4) after the typical fill time has lapsed without the monitoring device indicating the water level in the water vessel has reached the high level, indicating a leak in the water storage vessel, or (5) after an indication that the electrical output from the generator is outside a preset electrical output range, indicating an electrical error.

The system control can be capable of storing and transmitting at least one operating condition for display at the system, at least one remote location, or both. The operating condition can include one or more of the following: water production data, run time of the generator or pump, lapsed time between operation of the generator or pump, aggregate amount of water pumped, or maintenance time to clean an air filter, oil, or spark plug of the generator. The operating condition can be displayed on an LCD screen at the system.

The present invention can also include a method of operating a well pump and control system, with the system including a system controller, one or more monitoring devices which may include a pressure sensing device or float switch, a power source which may include a solar array, electric generator, or other power source, water distribution piping, at least one water storage tank or vessel, and a pump that provides water to the water storage vessel along with custom software and an assembly of electrical components and hardware assembled in an enclosure, which may be a NEMA rated enclosure to protect the components from the elements. The one or more monitoring devices may be for monitoring at least one of a water level in the water storage vessel, a flow rate of the pump, and operating conditions of the solar array, generator, or other power source.

The method according to some embodiments can include monitoring the water level in the water storage vessel with the monitoring device, and initiating operation of the pump when the water level reaches a preset low level. The monitoring can include the system control receiving a signal from the float switch or pressure switch to commence the system starting sequence. The system control can generally initiate operation of the pump to pump water to fill the water storage vessel to a preset high level and then initiate a shutdown sequence of the pump. In systems including a generator, the control can also start the generator during the system starting sequence and stop the generator during the system shutdown sequence.

The monitoring devices may monitor operation of the pump. If the water flow is less than a preset flow rate, the method can further include stopping operation of the pump by the system controller. The method can further comprise relaying an error condition. The method can further include restarting the well pumping and control system after a preset time has elapsed.

In some embodiments, the method can further include at least one of the following: (1) monitoring a fuel level and displaying a low fuel message, (2) monitoring an oil level and displaying a low oil message, (3) monitoring ambient temperature and displaying a low ambient temperature message, (4) monitoring a typical fill time of the storage vessel by monitoring the water flow rate from the pump, the quantity of water required to raise the water level to the high level, or the time lapsed between start and stop of the pump, or (5) monitoring electrical output from the generator. The system control ceases operation of the pump and generator at an occurrence of one of the following: (1) after the fuel level reaches a preset low fuel level, (2) after the oil level reaches a preset oil low level, (3) after the ambient temperature reaches a preset low ambient temperature, (4) after the typical fill time has lapsed without the monitoring device indicating the water level in the water vessel has reached the high level, or (5) after an indication that the electrical output from the generator is outside a preset electrical output range.

In some embodiments, the system controller can relay an error message at the occurrence of one of the following: (1) after the fuel level reaches a preset low fuel level, indicating the generator requires fuel, (2) after the oil level reaches a preset oil low level, indicating the generator requires oil (3) after the ambient temperature reaches a preset low ambient temperature, indicating the generator and pump should not be run (4) after the typical fill time has lapsed without the monitoring device indicating the water level in the water vessel has reached the high level, indicating a leak in the water storage vessel, or (5) after an indication that the electrical output from the generator is outside a preset electrical output range, indicating an electrical error.

In some preferred embodiments, the present disclosure is directed to a pump controller system designed and capable of preventing overflows of water in distant storage tanks. In some preferred embodiments, aspects of the present disclosure also can be adapted to a pump controller system designed and capable of use with any type of liquid, such as oil or another liquid in distant storage tanks.

These and various other objects of the present invention will become apparent to those skilled in this art upon reading the accompanying description, drawings, and claims set forth herein.

DETAILED DESCRIPTION OF THE INVENTION

Figure 1:
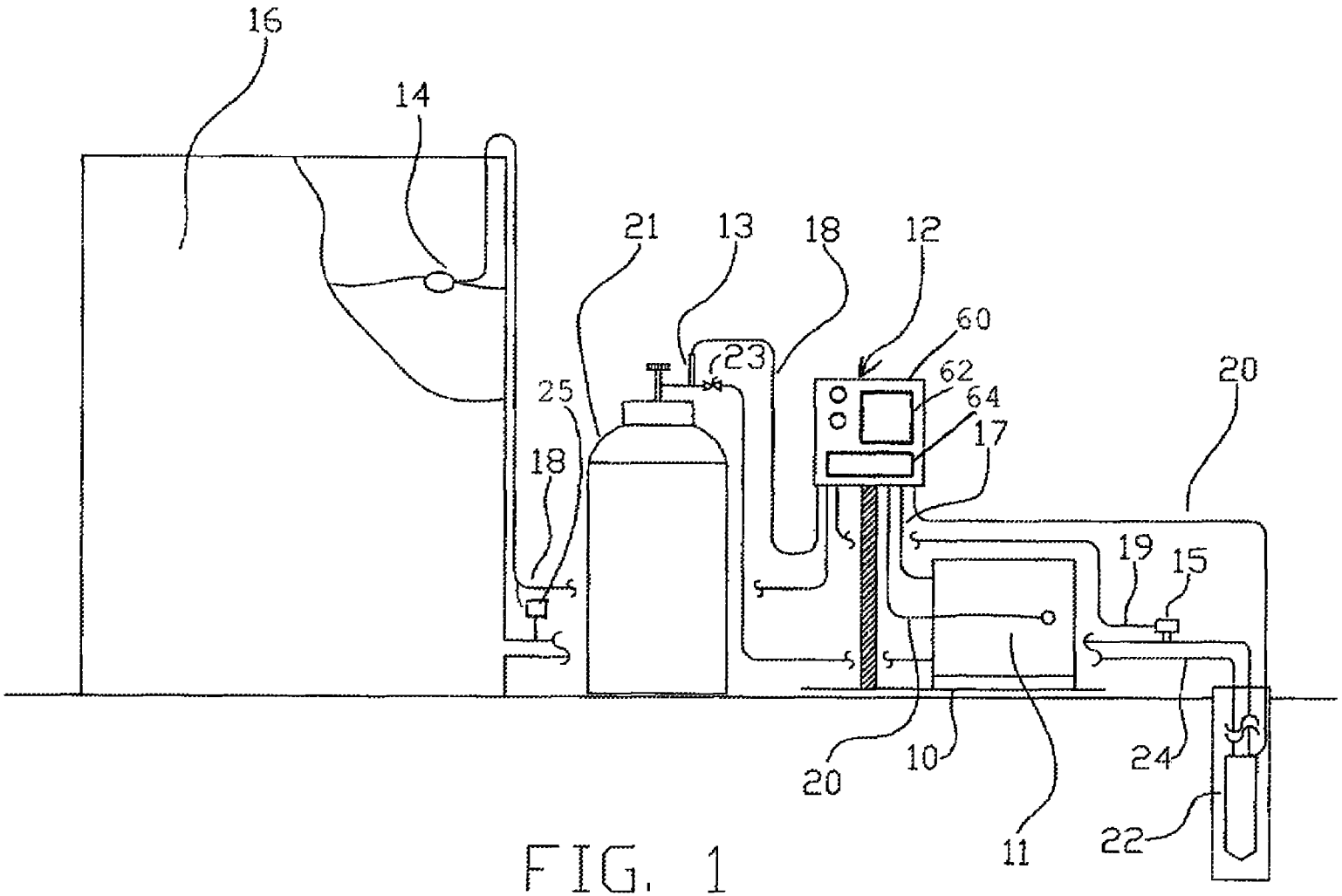
FIG. 1 is a front view schematically illustrating the well pumping and control system according to one aspect of the present disclosure.
Figure 2:
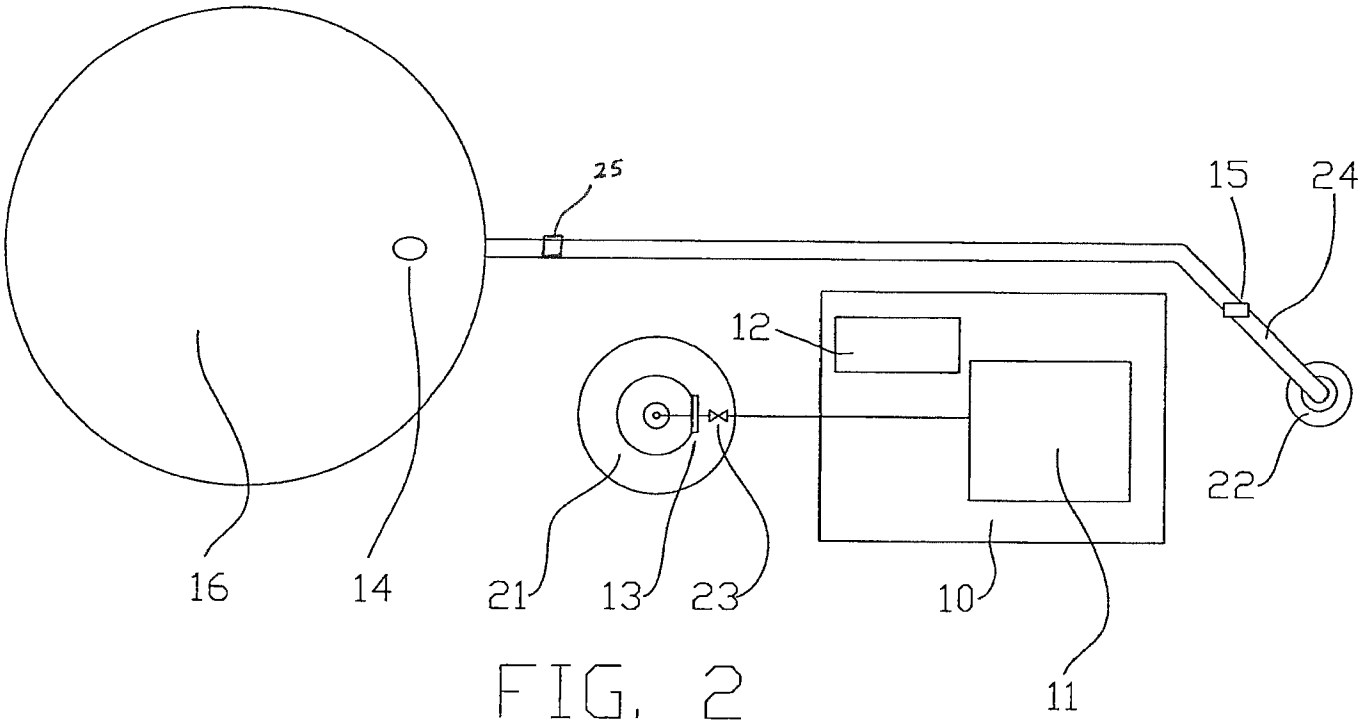
FIG. 2 is an overhead view of the well pumping and control system.

FIG. 1 illustrates one embodiment of the well pumping and control system according to the present invention. As seen in the drawings, the well pumping and control system can be a skid assembly 10 generally including an electric generator 11 driven by propane or other fuel engine that will accommodate the electrical power requirements of a pump 22, which is preferably a deep underground well pump. An example of such an electric generator is an EcoGen series generator available from GENERAC Power Systems of Waukesha, Wis. A system control panel 12 is electrically connected by a properly sized cord and plug assembly 20 for the required electrical load necessary to run the generator and pump. The system control panel 12 is preferably in an enclosure, which may be a NEMA, hinged door enclosure, and inside the panel includes a display 62, user input 68, such as a keyboard, touch screen, etc., and a system control or processor 60 that enables outputs and receives and monitors inputs from a series of field devices including a float switch 14 or a water pressure switch 25, a fuel pressure switch 13, and a flow switch 15 as can be seen on FIG. 2 of the drawings. The float pressure and flow switches serve to monitor pumping control variables and system status conditions for an outdoor application at a water well site typically where utility power is not readily accessible, such as on remote and livestock water wells and reports system conditions to the system control panel, which in turn controls operation of the pump in response to such inputs to maintain the desired water level.

The float switch 14 is placed in the target water storage vessel 16 or a pressure switch 25 is placed into the water pipe 24 between the well discharge and the water storage vessel 16 to monitor for predetermined low and full water level conditions. The float switch 14 can be any high quality, durable float actuated, magnetic or mechanical micro switch rated for 12 volts DC or higher with a at least one set of normally open contacts, compatible with the ambient temperatures of the application. An example of a preferred water level float switch for this application would be a Dayton 3BY80 float switch. This switch is a durable switch compatible with the ambient temperatures of the application and is generally capable of greater than ten thousand cycles over its operating life. The pressure switch 25 can be any type of durable liquid pressure sensing micro switch, with independent dual sets of normally open and normally closed contacts rated for 12 volts DC or higher. An example of a preferred water pressure switch for this application would be a PSW-852CL pressure switch from OMEGA Engineering of Stamford, Conn. The pressure switch 25 is a durable switch compatible with the ambient temperatures of the application. It has a field settable hysteresis and set point repeatability of +/−2% and a greater than ten thousand cycle rated operating life. The float switch 14, or the water pressure switch 25, is electrically connected by an electrical quick change cable and receptacle assembly 18. An example of a preferred assembly would be a Brad Harrison quick change cable and receptacle assembly model 112020A01F060 with a 1R2006A20A120 and a 1R2004A20A120.

When the float switch 14 or the water pressure switch 25, detects a low level condition in the water storage vessel 16, an electric signal will be sent from the switch to the well pumping and control system control panel 12 where the low level signal is confirmed by the system control after a preset time to confirm the actual low level condition. According to a preferred embodiment, the system control 12 operates on a pre-programmed sequence, an example of which follows. Once a low level condition in the storage vessel is confirmed, the control panel 12 will begin a system start up sequence with a start signal being sent to the skid mounted electric generator 10. The generator 10 will receive a start signal from the system control panel 12 starting the electric generator 11 producing electric power to support an electric motor on an underground deep well pump 22.

According to a preferred embodiment, once the generator 11 has started, the ON condition will be confirmed at the system control panel 12 receiving a signal of the output from the electric generator 11. Once the electric generator output is confirmed at the system control panel 12, a preset run time can be allowed to elapse allowing the engine of the electric generator 11 to warm up. After the preset warm up period is completed the system control panel 12 will turn on the electric power to the underground deep well pump 22, which can be any DC or sixty cycle AC electric motor driven submersible pump rated for the installation and compatible with the environmental conditions of the installation. The pump 22 is electrically connected to the system control panel by a cord and plug assembly 20, producing a water flow from the underground deep well pump 22 through a water pipe 24 to the water storage vessel 16, filling the water storage vessel 16 to a predetermined full level as signaled by the float switch 14 position of 45 degrees above horizontal position or the water pressure switch 25, pressure setting. When the water level in the water storage vessel 16 reaches a full condition as measured by the float switch 14 at a predetermined position or the water pressure switch 25 at a preset pressure setting, a signal will be sent from the float switch 14 or the water pressure switch 25, to the system control panel 12 to begin a controlled shutdown process of the underground deep well pump 22 and electric generator 11. The electrical supply to the well pump 22 will be turned OFF by the system control panel 12. The electric generator 11 will continue to run for a preset time to allow the electric generator 11 to warm down with no load and then it will shut off ready for the next fill cycle process to begin.

According to a preferred embodiment, a flow switch 15 is located in the water pipe 24 between the well discharge and the water storage vessel 16. An example of a mechanical switch is a Dwyer F.S.-2 vane flow switch available from DWYER Instruments Inc. of Michigan City, Ind. and an example of a thermally actuated flow switch for this application would be a FST-211-SPST switch from OMEGA Engineering of Stamford, Conn. The flow switch 15 can be any temperature, magnetic or mechanically actuated micro switch rated for 12 volts DC or higher with a at least one set of normally closed contacts capable of sensing the lowest water flow level of the installation. The flow switch 15 is durable and compatible with the ambient temperatures of the application, can have a field adjustable set point, and generally is rated as a greater than ten thousand cycle operating life. The flow switch is electrically connected to the system control panel by an electrical quick change cable and receptacle assembly 19. An example of a preferred quick change cable and receptacle assembly would be a Brad Harrison model 113020A01F060 with a 1R3006A20A120 and a 1R3004A20A120. The flow switch 15 will confirm water flow within a preset time after the well pump is turned on. If no water flow is sensed or if water flow stops through the flow switch 15 for a preset time, then a signal will be sent from the flow switch 15 to the system control panel 12 to turn off the electrical power being supplied to the underground deep well pump 22 protecting it from operating in a no flow condition due to a frozen water pipe 24, a weak water supply in the well or any other condition that could prevent water from flowing when the underground deep well pump 22 is ON.

According to a preferred embodiment, an alarm or other fault condition notification can be sent, for example, via text message or other indicator on the LCD screen 62 inside the system control panel 12 to indicate the no flow condition and can be automatically forwarded to a central control or operator, such as wirelessly, via e-mail, text, or other notification. After a preset time period has elapsed to allow a well to recharge with ground water seepage or to allow frozen water pipes 24 to thaw, the system control panel 12 will automatically initiate a new start up sequence still providing no flow pump protection by means of the flow switch 15. This sequence will repeat until the water storage vessel 16 has reached a full level as measured by the float switch 14 in the water storage vessel 16 or the water pressure switch 25 in the water pipe. A reset button inside the system control panel 12 thereafter can reset the text message and the well pumping and control system 10, clearing the condition and allowing immediate operation but still monitoring any no flow condition reoccurrence.

According to a preferred embodiment, to aid in the prevention of operating in a condition where a frozen water pipe may be present, a temperature sensor located inside of the system control panel 12 will prevent the start up of the system anytime that the temperature has dropped below a set temperature (e.g. thirty two degrees Fahrenheit (32.degree. F.) or below) and will not allow the system the system to begin a startup sequence until the temperature sensed inside the control panel 12 has risen to a set temperature (e.g. forty degrees Fahrenheit (40.degree. F.)) or the system reset button inside the system control panel 12 is initiated. A text message will be displayed of the condition on the LCD screen inside the system control panel 12 until the condition has cleared or the reset button inside the system control panel 12 has been initiated.

According to a preferred embodiment, fuel pressure is monitored by a pressure switch 13 with a Division 1 Hazardous rating with a least one set of normally closed contacts rated for 12 volts DC or higher with an adjustable set point range from eight to thirty pounds per square inch and at least a maximum working pressure rating of three hundred pounds per square inch and rated for outdoor installations. An example of a preferred pressure switch would be a PSW12T-AS switch available from Omega Engineering of Stamford, Conn. This pressure switch is electrically connected by an electrical quick change cable and receptacle assembly 13. An example of a preferred quick change cable and receptacle assembly would be a Brad Harrison model 112020A01F060 with a 1R2006A20A120 and a 1R2004A20A120 cable and receptacle assembly.

According to a preferred embodiment, the fuel pressure switch 13 is located between the propane 21 tank, or other fuel supply, and the pressure regulator 23 supplying the electric generator 11. The fuel pressure switch 13 monitors the tank fuel level and senses a low fuel pressure condition, and will send a signal to the system control panel 12 to initiate a shutdown sequence when the fuel pressure drops to the set point of the pressure switch 13 while the system is running Once a low fuel pressure level is sensed, a text message of the condition will be displayed on the LCD screen inside the system control panel 12 and the system will be prevented from restarting until the system is refueled to an adequate pressure above the pressure switch 13 set point and the system reset button inside the system control panel 12 is initiated, clearing the condition and the text message.

According to a preferred embodiment, the well pumping and control system 10 further can display on the LCD screen inside the system control panel 12 a series of maintenance text prompts, including air filter change after five hundred hours of operation, oil change after five hundred hours of operation, and/or spark plug change after five hundred hours of operation. All maintenance text prompts are based on operating hour interval times, recommended by the electric generator 11 manufacturer. Such prompts generally will be programmed into the system control inside of the system control panel 12, and a text message will be displayed at the end of each of these elapsed times to notify a technician/operator to perform the prompted task on the LCD screen inside of the system control panel 12. These maintenance text prompts are resettable by pressing the system reset button inside the system control panel 12.

According to a preferred embodiment, the well pumping and control system 10 will display on the LCD screen inside the system control panel 12 operational text. Based on the measured flow rate of the pump at the installation, a calculated value of total gallons of water made up to one million gallons will be displayed as a default on the LCD screen. This total value is not resettable by an operator. Once the system has totaled one million gallons of water produced the value will change back to zero and start counting up to one million gallons again, repeating this cycle throughout the systems' life. A second water production value will be displayed on the LCD screen inside of the system control panel 12 as a secondary default screen, displaying total gallons of water pumped since last reset. This is to allow an operator to quantify gallons of water produced between visits to the well site. In one example operation, a counter is reset to zero by pressing the system reset button inside the system control panel 12 for five seconds. After pressing the system reset button for five seconds, the counter value will reset back to zero and will restart totaling gallons of water when the water production process starts again.

According to a preferred embodiment, calculations are made based on the water storage vessel 16 capacity of the measured underground deep well pump 22 discharge rate and the float switch 14 or the water pressure switch 25 settings to determine the approximate time required for the deep well pump to fill water storage vessel 16 to a desired or necessary level. The storage vessels 16 are installed on well sites as needed and generally range between 10,000 and 40,000 gallons. Storage reserves also range and depend on livestock loads and pump flows, and can range, for example, from a system that operates nearly every day for 8 hours or more to systems that operate once a week or less. Based on the calculations, a time value plus a selected percent of the calculated time will be inputted into the system control 60 inside on the system control panel 12. When the pump operating time with a confirmed flow at the flow switch 15 exceeds this inputted value, the system control panel 12 of the well pumping and control system 10 indicates that the system has exceeded a reasonable run time, prompting the operator to check for major a leak in the piping system. The system also generally will proceed through a shutdown sequence and will not restart until an operator has pressed the system reset button inside the system control panel 12. This feature is intended to prevent the waste of fuel and preserve ground water.

Figure 3:
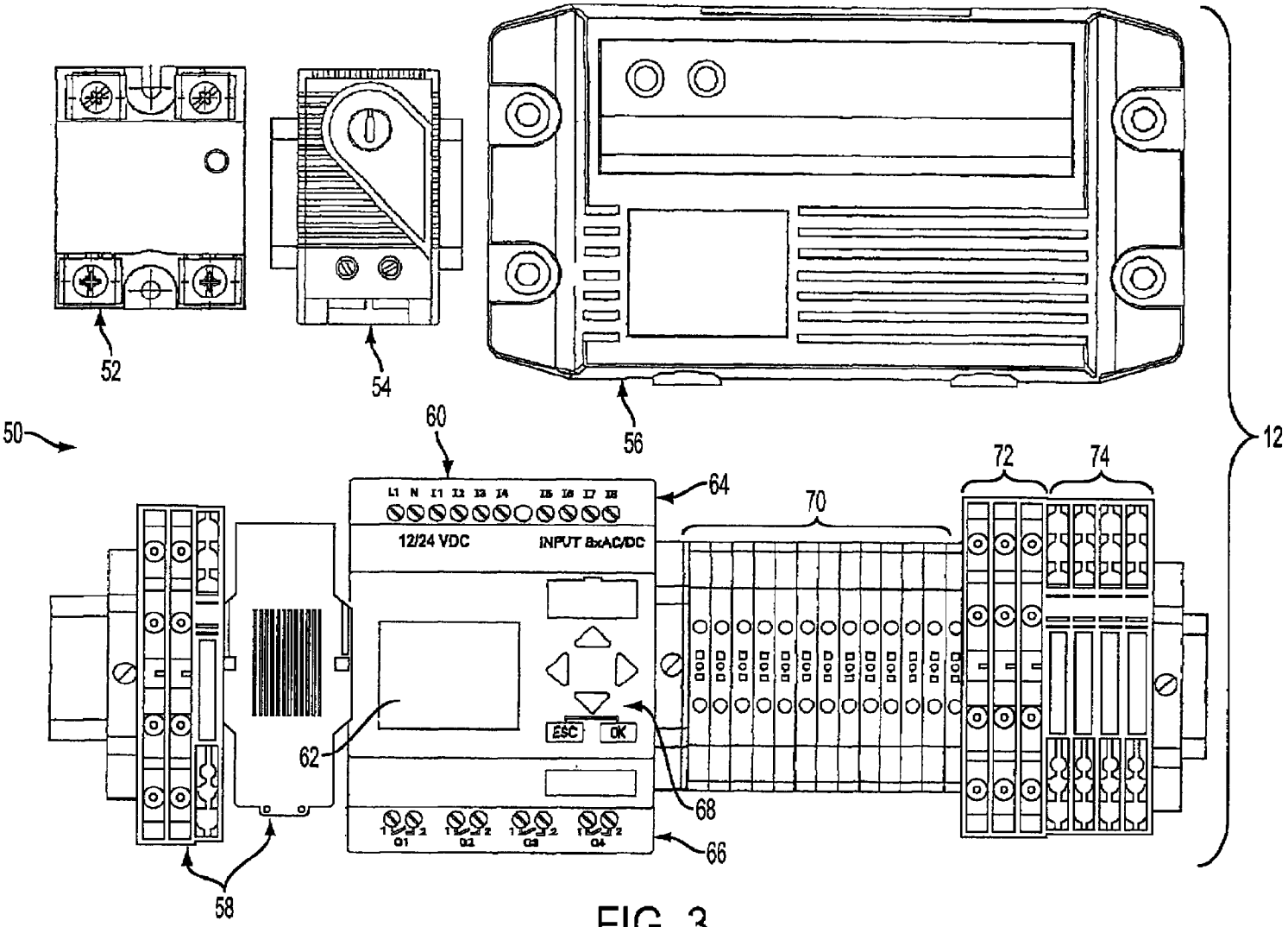
FIG. 3 is a front view of exemplary components in the control panel.

FIG. 3 is a front view of exemplary components in the control panel. FIG. 3 shows components of the interior 50 of control panel 12, including pump relay 52, thermostat 54, battery charger 56, relays 58, controller 60, terminals 70, fuses 72, and relays 74. Controller 60 includes LCD screen 62, inputs 64, outputs 66, and user inputs 68 (such as keyboard, entry keys, etc.). Since additional or fewer components can be included in the interior 50 of control panel 12, the elements shown in FIG. 3 should not be limiting in any manner, and are provide as an exemplary configuration.

Figure 4:
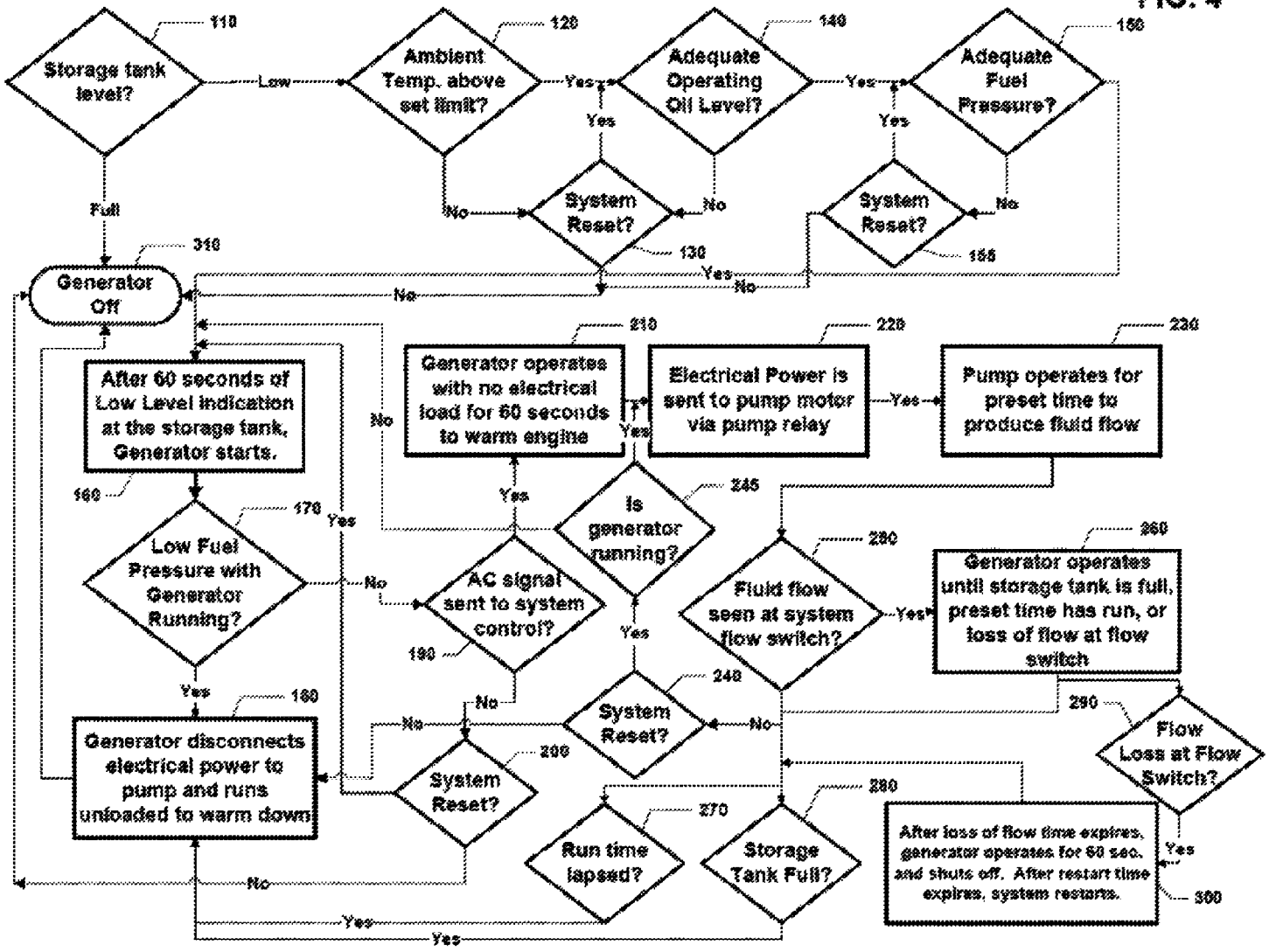
FIG. 4 is a flow chart showing an exemplary sequence of operation of the well pumping and control system of FIG. 1.

FIG. 4 is a flow chart showing an exemplary sequence of operation of the well pumping and control system. The exemplary method, indicated at 100, includes a step 110 that analyzes the level of water level in the water storage vessel. If the water level indicates a full level, the generator remains off as shown in step 310. If the water level is indicated at a low level, the method proceeds from step 110 to step 120. At step 120, the ambient temperature surrounding the well system is measured. If the ambient temperature is not above 32, the method returns to step 310 with the generator remaining off. If the ambient temperature surrounding the well system is above 32, the method proceeds from step 120 to step 140. Alternatively, the method can be reset, such as pressing a reset button as shown in step 130. The method then proceeds from step 130 to step 140. At step 140, the method measures the engine oil level. If the engine oil level at step 140 is not okay, the method returns to step 310 and the generator remains off. If the engine oil level is acceptable, the method proceeds from step 140 to step 150. Alternatively, the engine oil level indication can be reset such as indicated at step 130 and the method then proceeds to step 150.

At step 150, the method measures the fuel pressure. If the fuel pressure is not adequate, the method returns to step 310 and the generator remains off. If the fuel pressure is adequate, the method proceeds to step 160. Alternatively, the fuel pressure monitor can be reset such as shown at step 200 and the method can return to step 160.

At step 160, the method measures a time interval that lapses to indicate that a low water level at the water storage vessel is indicated. For example, as indicated at step 160, after sixty continuous seconds have lapsed, the generator will start and produce electric power. The method then will proceed from step 160 to step 170 where fuel pressure will be measured. If the fuel pressure is indicated to be low, the method proceeds from step 170 to step 180 with the generator disconnecting electrical power to the pump and the generator runs for sixty seconds to warm down and then proceeds from step 180 to step 310 to switch the generator off. If at step 170, a low fuel pressure is not indicated, the method proceeds to step 190. At step 190, the AC electricity signal to the system control is monitored for two seconds. If this is indicated, the method proceeds from step 190 to step 210. If it is not indicated, the method proceeds from step 190 to step 310 with the generator switching off. Alternatively, the method can proceed from step 190 and indicate that a reset button has been pressed and the method can return to step 160 to proceed as indicated above.

At step 210, the generator operates with no electrical load for sixty seconds to warm the engine and the method then proceeds to step 220. At step 220, electrical power is sent to the submersible pump motor by way of a system control pump relay and the method proceeds to step 230. Alternatively, the reset button can be pressed as indicated at step 240 and the method then proceeds to step 180 as detailed above.

At step 230, the submersible pump operates for the preset time of about sixty seconds to produce water flow to confirm flow at the flow switch preventing continued operation in a no flow condition, such as a frozen pipe. The method then proceeds from step 230 to step 250 where water flow is monitored at the system flow switch. If water flow is not indicated at the system flow switch, the method proceeds from step 250 to step 180 as indicated above. Alternatively, if water flow is not seen at the system flow switch, the method can be reset as indicated at 240 and return to step 230 as indicated above. If water flow is indicated at the system flow switch, the method proceeds from step 250 to step 260. At step 260, the generator operates and provides electrical power to the submersible pump motor until the storage tank indicates a full level, or until a preset allowed run time is elapsed, or until a loss of flow is indicated at the flow switch.

The method then proceeds from step 260 to either step 270, 280 or 290. If the allowed run time has elapsed, the method proceeds from step 260 to step 270. If the water storage tank indicates a full level, the method proceeds from step 260 to step 280. If step 260 indicates a loss of flow at the flow switch, the method proceeds from step 260 to step 290. If the allowed run time has elapsed at step 270, the method proceeds to step 180 as indicated above and then proceeds to switch off the generator at step 310. If at step 280 the water storage tank as full, the method proceeds to step 180 as indicated above and then proceeds to step 310 to switch the generator off. If a loss of flow at a flow switch is indicated at step 290, the method proceeds to step 300. At step 300, after the preset loss of flow time expires, the generator will operate for sixty seconds and shut off. Then, after a preset restart time has expired, the pumping process will be restarted and operated until the water storage tank indicates a full level. After step 300, the method proceeds from step 300 to step 280 to indicate that the water storage tank is full and then proceeds from step 280 to step 180 as detailed above and eventually to step 310 to switch the generator off.

The well pumping and control system, according to such embodiments, 10 addresses several shortcomings realized in prior systems, including providing the ability to operate in both daylight and night hours along with significantly greater flow rates, giving the well pumping and control system 10 water production capabilities that exceed those of wells supported only by solar powered water production systems, and potentially allowing the user of the well pumping and control system 10 opportunities for greater livestock grazing and production capabilities where water is currently the limiting factor.

Operating the well pumping and control system 10 in place of a windmill water production system will produce greater flow rates than windmill powered water production systems and will prevent the waste of ground water which is pumped from the ground to a water storage vessel, since windmills have no level control capabilities, and once the storage vessel is full, excess water typically is then allowed to spill out onto the ground, much of which evaporates into the air wasting the precious resource. The maintenance of windmill water production systems also can be very expensive and dangerous to the operator and technicians. Typical frequent maintenance tasks are replacement of the seals at the bottom of the well piping requiring the expense of several man hours and the use of a crane type vehicle. Servicing the gear box assembly at the top of the windmill pumping system tower requires a technician to climb high up to the top of the windmill tower or be raised to the area by some lifting device so that lubrication, oil change maintenance and repairs to that portion can be performed. This exposes a technician to the hazards of working in conditions at heights with tools, lubricants, and being subject to wind gusts that can create an extremely dangerous environment. By the use of the well pumping and control system 10 in place of windmill water production system, the operator will see a reduction in maintenance costs and the substantial elimination of the hazards of working at heights to the technicians conceivably preventing injury and even death involved in accidents associated with working at the heights on windmill towers along with the conditions involved with said activities.

The use of the well pumping and control system 10 in place of a non-intelligent electrical generator also can provide many additional advantages. A full command of the water production operation will be taken by the well pumping and control system 10. While reductions in labor and operating costs due to frequent trips to the well site to refuel to start the generator were the primary focus of the invention, a substantial realized benefit to the operator is that the well pumping and control system 10 will monitor critical system dynamic conditions. Controlling the system operations to operate with respect to these conditions, will result in safe operation to both the electric generator 11 and the underground deep well pump 22 and will prevent both electric generator 11 and underground deep well pump 22 from operating in out of electrical design tolerance conditions such as over voltage, under voltage, generator, low frequency, or the frequency of the generator shutting down under an electrical load (pump motor electrically connected).

Figure 5:
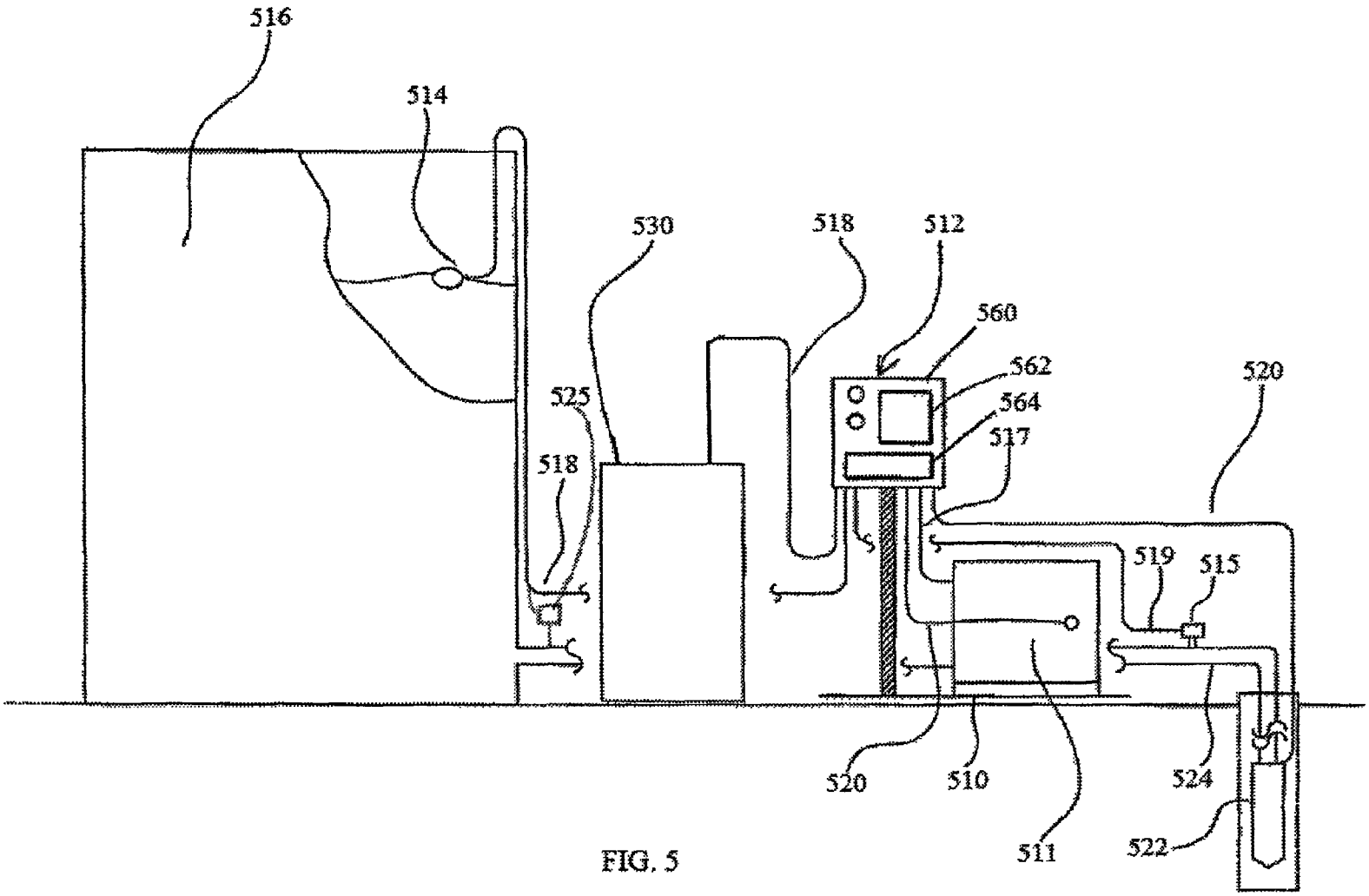
FIG. 5 illustrates a pumping and control system according to another aspect of the present disclosure.

In another aspect, the present disclosure is directed to a pump controller and system capable of preventing overflows at distant storage tanks as shown in FIG. 5. The system can include a distribution pump controller 560, sometimes referred to herein as a "pump controller," "system controller," "system control," or simply as a "controller," one or more monitoring devices which may include a pressure sensing device 515, 525 or float switch 514, a power source which may include one or more solar arrays 530, generator 511, or other power source, water distribution piping 524, at least one water storage tank or vessel 516, which may be located at an elevation above the pump and/or water source, and a pump 522 that provides water to one or more water storage vessels 516. The system can also include custom software and an assembly of electrical components and hardware assembled in an enclosure 575. The enclosure 575 may be a NEMA rated enclosure capable of protecting the components from the elements.

FIG. 5 illustrates a pumping and control system according to another aspect of the present disclosure. As seen in the drawing, the pumping and control system can be a skid assembly 510 generally including a power source 511. The power source 511 may include DC power converted from solar power from one or more solar arrays 530 and is sufficient to power a pump 522. A system control panel 512 may be electrically connected by a properly sized cord and plug assembly 520 sized for the required electrical load necessary to run the power source and pump. The system control panel 512 can include a system control or processor 560 that enables outputs and receives and monitors inputs from one or more monitoring devices. The monitoring devices may include a float switch 514 or a water pressure sensing device 525, and/or a flow switch 515. The float, pressure sensing device, and flow switch may serve to monitor pumping control variables and may report conditions to the system control panel 512, which in turn may control operation of the pump in response to inputs.

Figure 6:
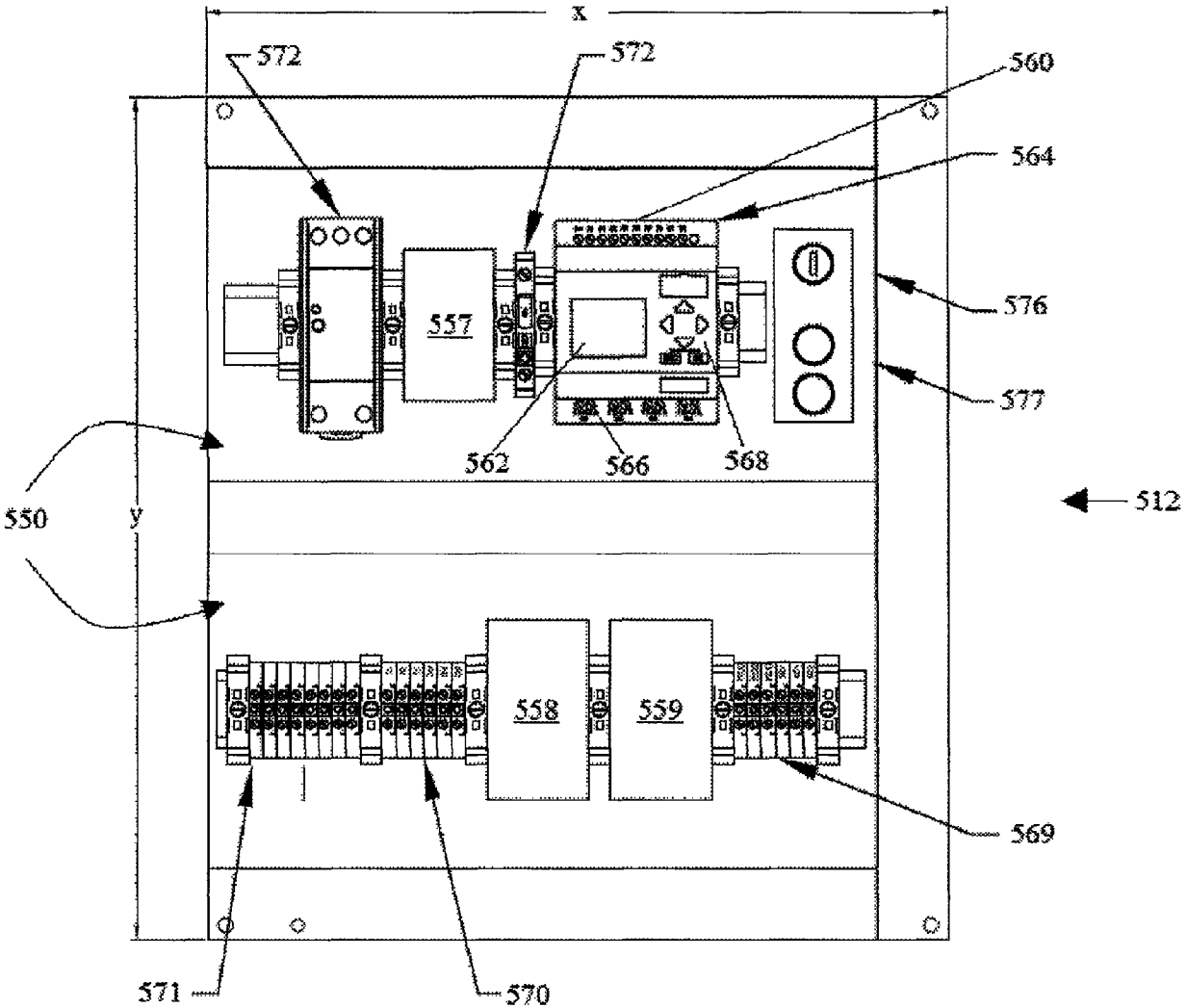
FIG. 6 is a front view of exemplary components in the control panel.

FIG. 6 is a front view of exemplary components of the control panel 512. FIG. 6 shows components of the interior 550 of the controller panel 512, including controller 560, relays 557, 558, 559, terminals 569, 570, 571, and fuses 572. The control panel 512 can also include an LCD screen 562, inputs 564, outputs 566, user inputs 568 (such as keyboard, entry keys, etc.), and/or push buttons 577 and can have a height y and a width x. For exemplary purposes only, the height y could be 14.75 inches and the width x could be 12.88 inches. The elements shown in FIG. 6 should not be limiting in any manner, and are provided herein as an exemplary configuration.

Figure 7C:
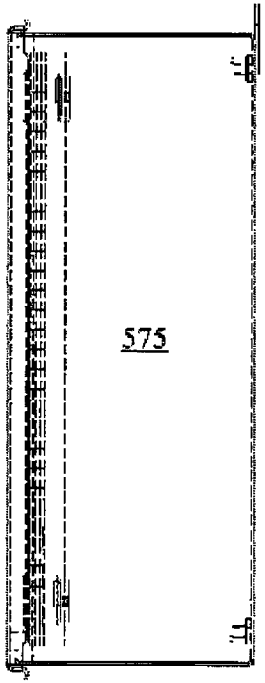
FIGS. 7*a*-7*c* show front, top, and side views of an exemplary enclosure for the control panel of FIG. 6.
Figure 7B:
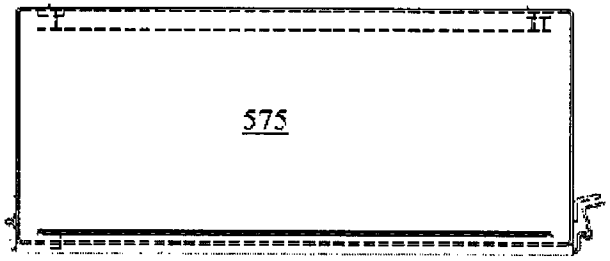
Figure 7A:
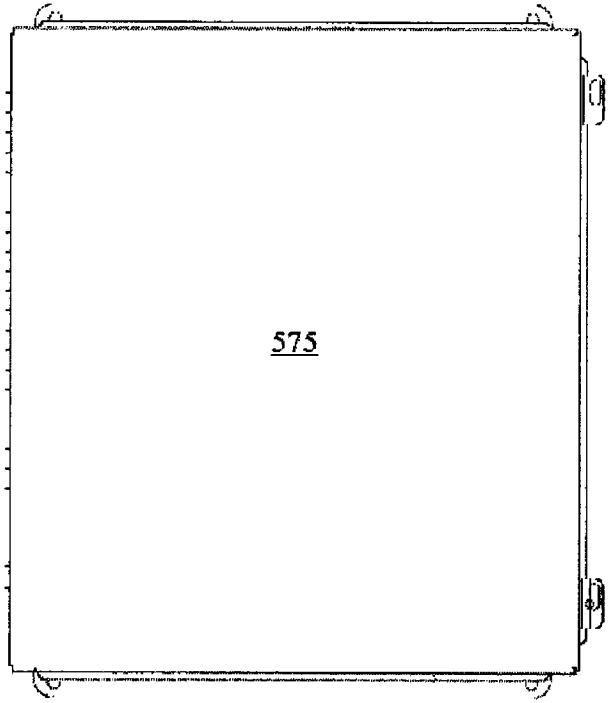

FIGS. 7*a*-7*c* show front, top, and side views of an exemplary enclosure 575 for the control panel of FIG. 6. The enclosure 575 may be a NEMA rated hinged door enclosure.

According to some embodiments, the pump controller 560 can be used for controlling the pump 522 to distribute water or other fluid from a well or reservoir or storage vessel across a landscape to a distant storage vessel 516, such as one located at or across an elevation that can be higher than the well, reservoir or storage vessel. The pump controller can include a set of electrical and electronic components, which are typically located in a weather tight enclosure. While it can be otherwise located, the pump controller is typically installed at a convenient location, which can be at or near a solar array, generator 511, or other power source that electrically supports the pump 522. The array and controller 560 are also typically near the location of the distribution pump 522, but can also be otherwise located.

The pump controller 560 can operate with either a DC power input or an AC power input, and may be designed to automatically accept a particular power source, such as, for example, accepting the AC input as the priority power source when AC is connected. The pump 522 can be located in a well, reservoir, or storage vessel or in a fluid piping circuit fed from a source, such as one of the sources mentioned herein. As will be apparent to one of ordinary skill in the art, the pump 522 may also be otherwise located without departing from the scope of this disclosure.

Figure 9:
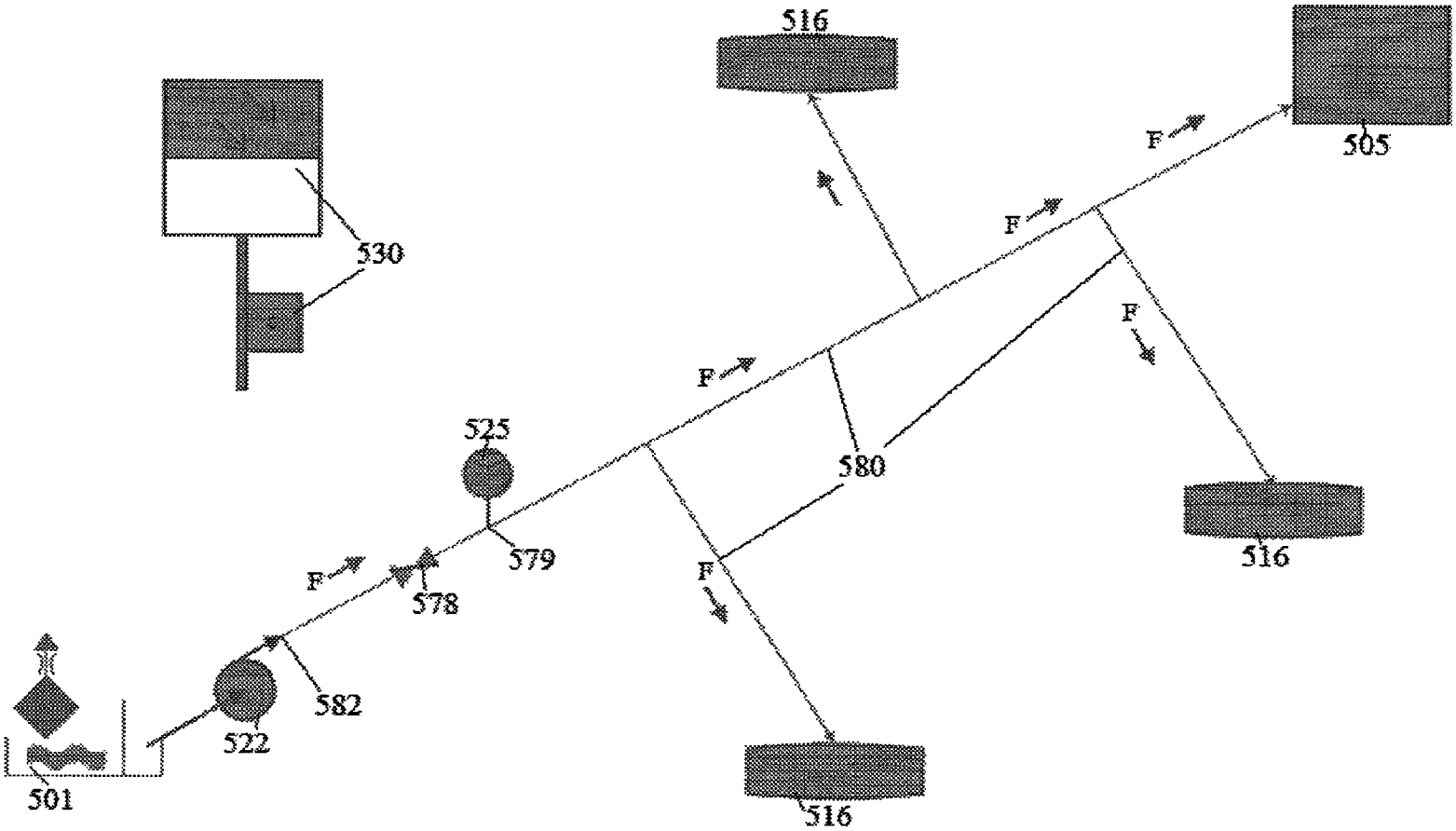
FIG. 9 is an overview of the system of FIG. 5.

In a preferred embodiment, the controller 560 may be electrically connected to one or more solar arrays 530. One array may be dedicated to provide power to the pump and a second array, which may be smaller, may be dedicated to provide power to the control circuitry, thus electrically supporting the control system. The pump power feed can be connected to the power relay output 574 of the controller 560. As shown in FIG. 9, the discharge of the pump 522 may feed into a piping circuit, and a check valve 578 may be located on the discharge line coming out of the pump. The check valve 578 does not have to be precisely positioned for each use, but generally being closer to the discharge port 582 of the pump can, in some embodiments, prevent fluid from draining back through a distribution piping circuit or network 580.

According to some embodiments, the pump controller is designed to operate in multiple modes and may include a mode selector switch 576 operable to select an Automatic, Off, or Manual mode. Further, according to some embodiments, the pump controller 560 can be a standalone solar pump controller, can be automatic, or can be combined with a well pumping and control system, such as that described in pending U.S. patent application Ser. No. 13/167,328.

In a preferred embodiment, the pump controller 560 can receive DC power from either a combination of battery and solar charger panels, a dedicated set of 12-volt solar panels (typically used for charging 12-volt automobile or Deep Cycle batteries), or the like.

In some embodiments, when the Controller's selector switch 576 is set in automatic mode and used as a standalone controller for a solar distribution pumping system, the controller 560 can, through preprogrammed settings, automatically turn the pump 522 on or off depending on environmental factors and/or sensor feedback. For example, the Controller 560 in automatic mode could be programmed to do one or more of the following:

1. Power ON at sunrise and power OFF at sunset.
2. Power ON at sunrise or when sunlight is present and power OFF with loss of sun light. As the controller powers ON when sunlight is present, the controller 560 can be powered on, with the operation being in the state that the selector switch is set (i.e., auto, manual or off).
3. Monitor static water pressure in the distribution piping 580 through a pressure switch or pressure transducer 525 located at the discharge of the pump that is controlled by the controller. Static water pressure will change in the distribution piping as the fluid level in the distant storage vessel falls or rises.
4. Display, e.g. on the text screen and/or in text messages, at the controller operation state (i.e. Manual, Auto, OFF), pump status (On/Off), and/or the percent of fluid level in the distant storage tank (0-100% full)

The controller 560 can include several electrical components as shown in FIG. 6, which may be mounted in an enclosure 575, which is preferably weather tight. Electrical components of the controller may include one or more of:

- A Microprocessor controller that may have digital and analog inputs and digital outputs.
- A three position maintained selector switch that may be electrically connected to a 12 volt common, a digital input to the microprocessor controller for manual ON, and a digital input into the microprocessor controller for an Auto ON.
- An AC power cord with a male plug to connect to an electrical generator AC output.
- One DC power supply with an AC input and a DC output, to provide DC control power when plugged into an AC source such as a generator.
- One control relay 574 that may be used for two purposes.
  - First to switch AC power ON at the input of the DC power supply.
  - Second to input a signal representing "AC present" to the Microprocessor controller. The relay energizes instantly when AC power is present.
- Two power relays 558, 559:
  - One relay for the purpose of energizing and de-energizing DC power to the pump based on fluid/water pressure and level in the distant storage vessel. The power relay's coil is electrically connected to an output from the microprocessor controller.
  - One relay for the purpose energizing and de energizing AC power to the pump based on fluid/water pressure and level in the distant storage vessel. The power relay's coil is electrically connected to an output from the microprocessor controller.
- A fuse 572 on the DC output of the DC power supply, to protect the power supply from overload.
- A cast of terminal blocks 569, 570, 571 for the purpose terminating wires between the AC power cord, solar arrays 530, the pressure sensing device 525 and wiring internal to the controller 560.
- A solar array 530 to provide DC power to the system control 560.
- A solar array 530 to provide DC power to the pump 522.

The system control 560 can operate on a pre-programmed sequence, an example of which follows: Once a low level condition in the storage vessel is confirmed, the control panel 512 begins a system start up sequence with a start signal being sent to a power source 511, such as a generator. Such a configuration may be particularly suitable for embodiments including a generator which may be mounted onto a skid assembly 510. The power source 511 can receive a start signal from the system control panel 512 starting and can produce electric power to support an electric motor on the pump 522, which may be a deep underground well pump. It will be apparent to one of ordinary skill in the art, however, that other types of power sources 511 or pumps 522 will be suitable for use without departing from the scope of the present disclosure.

According to a preferred embodiment, sensing device 525 is a high resolution pressure sensor with high repeatability. The pressure sensing device 525 can be a pressure switch, but where higher pressure resolution is needed a pressure transducer may be preferred. Static fluid pressure in a vessel changes as the level of fluid/water rises or lowers in the vessel. In one example, water pressure will change approximately 0.433 psi for each foot of change in elevation. With a piping circuit 580 connected to the bottom of the storage vessel 516, the same pressure changes are also seen throughout the piping system 580 as the fluid/water level changes.

According to a preferred embodiment, the high resolution pressure sensing device 525 monitors the change in pressure due to the fluid level. Sensing this change in pressure in the piping system 580 allows the controller 560 to identify a fill level point in the storage vessel. When the fluid level in the storage vessel 516 drops, the pressure in the piping circuit 580 lowers in direct proportion. A set point can be selected and programmed in the controller 560 to recognize the storage vessel fluid level based on the fluid pressure change. When the controller 560 sees that the set point is met, the controller 560 can enable the pumping process in response.

According to a preferred embodiment, the controller 560 will not start the pump instantly on a low pressure input signal. Wind sloshing the fluid/water in an open-air higher elevation storage tank could cause enough change in pressure to enable an input signal, but pressure changes that result from the wind cycle on and off very quickly. For this reason, some embodiments may include a timer in the controller 560 that can be enabled when the pressure signal is enabled and can reset if the pressure signal cycles off. According to some embodiments, the low pressure signal must be enabled continuously, with no interruption, for the entire duration of the timer before the controller 560 will turn on the pump 522. This pump ON delay timer setting can be set by the installer in software or, in a preferred embodiment, by the operator using a switch on the controller. In a preferred embodiment a 30 to 90 second delay is typically sufficient prevent the controller from starting the pump when pumping is not desired.

According to a preferred embodiment, once the pump 522 has turned on, pressure will increase dramatically, due to the pressure introduced from the operation of the pump. A pump ON timer can be enabled in the software when the pump turns on and can allow the pump to remain on only for a preset time. This time can be selected by the installer, and can be determined by volume of water needed and the flow rate of the pump. For example, if the storage vessel need is 1000 gallons of fluid/water and the pump flow rate is 10 gallons per minute the timer setting will be ~100 minutes.

A number of commercially available water pumps may be utilized by various embodiments of the present invention. Various types of pumps may be selected according to a particular application without departing from the scope of this disclosure. In some embodiments, such pumps can include underground or submersible pumps, which may be deep pumps or deep well pumps. Examples of pumps that are well suited for use with aspects of the present disclosure include Grundfos SQ Flex series, which is available for example from TP Pump of Albuquerque N. Mex. These pumps are positive displacement pumps and are equipped with universal motors accepting either DC or AC power. Other commercially available pumps are also compatible with various embodiments of the present disclosure. According to a preferred embodiment, such pumps are suitable as long as they have either universal or DC motors. DC motor pumps are typically used with a DC drive sized for the motor. These various types of pumps are mentioned herein by way of example only, and as such are not intended as a limitation to the scope of this disclosure.

As shown in FIG. 9 as further detailed below, aspects of the present disclosure may be used with a fluid or water reservoir 501 that is located at an elevation lower than the distant storage vessel 505. The reservoir can provide fluid or water to the suction side of the pump either through submersion in the fluid or water or through piping that can be connected proximate to and/or between the bottom of the reservoir and the suction side of the pump 522. However, it will be readily apparent to one of ordinary skill in the art that the water reservoir, piping, and pump may be otherwise configured such that fluid may be provided to the pump.

As shown in FIG. 9, the pump discharge port 582 may be connected to a check valve 578; the check valve 578 may be connected to a tee 579 with a pressure sensing device 525 mounted at the tee. The tee 579 may be connected to distribution piping 580 which can be installed across a landscape to a higher elevation where a storage vessel 505 may be located. The piping 580 can be connected to the bottom of the storage vessel 505.

As shown in FIG. 9, across the piping 580 there can be a number of other storage vessels, tanks and/or other fluid or water holding receptacles 516 at elevations different than the storage vessel 505, such as, for example, lower than the storage vessel. These storage vessels, tanks and other receptacles 516 each can have mechanical means such as float valves 514 installed to control the level of fluid or water inside of each and prevent overflow.

By using the pumping and control system of the present disclosure in place of other systems, such as a windmill water production system, a reduction in maintenance costs and the substantial elimination of the hazards of working at heights can be realized. This could conceivably prevent injury to the technicians and even death resulting from accidents associated with working at the heights on windmill towers along with the conditions involved with such activities.

In a preferred embodiment, the pumping and control system of the present disclosure includes at least one solar array 530 and is capable of reducing costs in labor and operation due to reducing the frequency of trips to a well site to refuel and/or to start a generator.

In some embodiments, the pump and control system can also monitor critical system dynamic conditions. Controlling the system operations to operate with respect to these conditions, can result in safe operation of both the power source 511 and the pump 522 and will prevent both power source 511 and pump 522 from operating outside of electrical design tolerance conditions such as over voltage, under voltage, generator, low frequency, or the frequency of a generator shutting down under an electrical load and consequentially causing shutdown of an electrically connected pump motor.

As previously stated, aspects of the present disclosure can include custom software and an assembly of electrical components and hardware assembled in an enclosure 575, which may be a NEMA rated enclosure, to protect the components for the elements. The assembly can include the following electrical components and hardware, however, it will be readily apparent to one of ordinary skill in the art that other such electrical components or hardware could be chosen without departing from the scope of this disclosure. By example and without limiting the scope of the present disclosure, possible choices of electrical components and hardware can include:

- A micro-processor controller, an example of which is an IDEC Micro-Smart relay controller manufactured by the IDEC Corporation available at Western Switches of Phoenix, Ariz., is utilized with custom written software as the primary control component.
- A pump controller that can include:
  - One or more microprocessor controllers, a suitable example of which is an IDEC Smart Relay model FL1E-H12RCE, which can be found at: IDEC Corporation of Sunnyvale, Calif.
  - One or more AC to DC power supplies, a suitable example of which is an IDEC model PSSR-SC24, which can be found at: IDEC Corporation of Sunnyvale, Calif.
  - One or more control relays, a suitable example of which is an IDEC model RH3B-U, which can be found at: IDEC Corporation of Sunnyvale, Calif.
  - One or more power relays or contactors, suitable examples of which are ABB model AF09Z-220-00-20 or ABB model AF16-30-10-11, which can be located through: Thomas & Betts of Albuquerque, N. Mex., or WIKA Instrument Corporation of Lawrenceville, Ga.
  - One or more pressure sensing devices.
  - A pressure switch or a pressure transducer. A suitable example of a pressure switch is WIKA model PSD-30 from WIKA Instrument Corporation of Lawrenceville, Ga. A suitable example of a pressure transducer is a Pro-sense SPT25-20-0150D from Western Switches of Phoenix, Ariz.
- An AC power relay is used for AC power control and power isolation, an example is an ABB AF-16-30-10-11, made by the ABB Corporation and available from Western Switches of Phoenix, Ariz.
- A DC power relay is used for DC power control and power isolation, an example is an ABB AF09Z-22-00-20, made by the ABB Corporation and available from Western Switches of Phoenix, Ariz.
- A DC power supply, an example is a PS5R-SC24, manufactured by the IDEC Corporation and available in Sunnyvale, Calif., is used to convert AC power to DC control power.
- An AC control relay, an example is an RH-3B-U, manufactured by the IDEC Corporation and available in Sunnyvale, Calif., is used to sense AC power and enable a DC power supply.
- An assortment of readily available terminal blocks, a fuse block, a three position maintained toggle switch, wires and power cord and plug all sized for the applicable loads are also used.
- In a preferred embodiment, the assembled devices are mounted in an enclosure 75. Without limiting the scope of this disclosure, and by way of example only, one such enclosure is a NEMA rated outdoor enclosure, an example of which is a Weigmann B121206CH, available from Western Switches of Phoenix, Ariz.
- According to some embodiments, custom software may be written in Ladder or Function Block logic. However, other forms of programming logic may also be used if compatible. One such example of ladder logic software suitable for use with aspects of the present disclosure is Win Ladder by IDEC Corporation.

Figure 8:
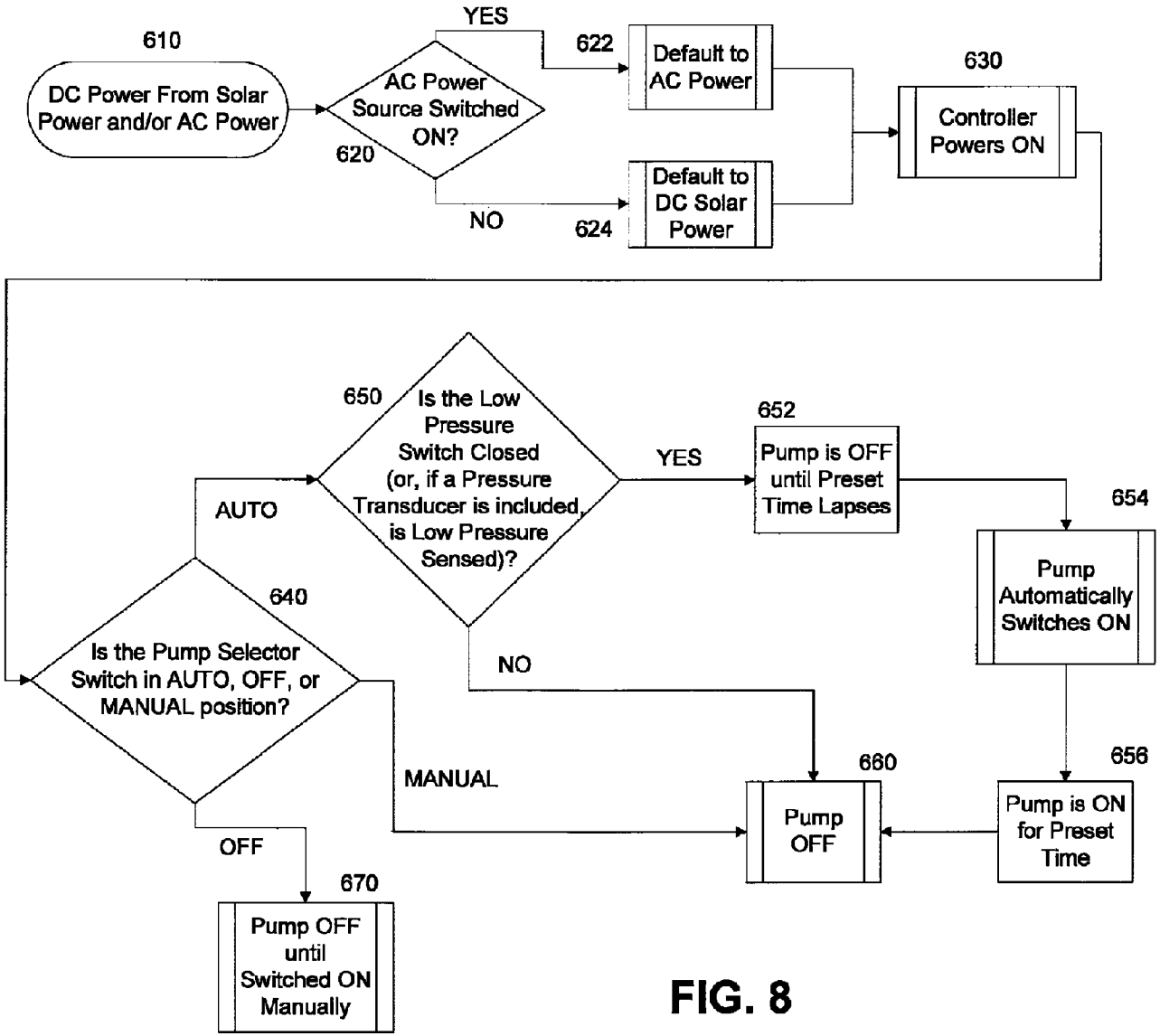
FIG. 8 is a flow chart showing an exemplary sequence of operation of the embodiment of FIG. 5 of the present disclosure.

FIG. 8 is a flow chart showing an exemplary sequence of operation of the embodiment of FIG. 5 of the present disclosure. The exemplary method, indicated at 600, includes a step 610 of providing DC power from solar and/or ac power to the system. If a power source is present, the method proceeds to step 620. At step 620, the method includes a step of determining whether an AC power source is switched on. If an AC power source is switched on, the method proceeds to step 622 and AC power is used as a default. If an AC power source is not switched on, the method proceeds to step 624 and DC power converted from solar power is used as a default.

After steps 622 and 624, the method proceeds to step 630. In step 630, the controller powers on. The method then proceeds to step 640. In step 640, the system checks the position of the pump selector switch 576 to determine whether the switch 576 is in an AUTO, OFF, or MANUAL position.

If the switch 576 is in the AUTO position in step 640, the method proceeds to step 650. In step 650, the method includes checking whether the low pressure switch is closed or, if a pressure transducer is used, whether low pressure is sensed by the transducer. If the pressure switch is not closed (or if the pressure transducer, if used in lieu of a pressure switch, does not sense a low pressure condition), the method proceeds to step 660. If the pressure switch is closed (or if the pressure transducer, if used in lieu of a pressure switch, senses a low pressure condition), the method proceeds to step 652. In step 652, the method includes checking that pressure switch is closed for a preset time. If the preset time lapses with the pressure switch closed (or if the pressure transducer, if used in lieu of a pressure switch, senses a low pressure), the method proceeds to step 654. In step 654, the pump is powered on. The method then proceeds to step 656. In step 656, a timer causes the pump to remain on for a preset time. Once the preset time has lapsed, the method proceeds to step 660.

If the switch 576 is in the OFF position, the method proceeds to step 660. At step 660, the pump is turned off.

If the switch 576 is in the MANUAL position, the method proceeds to step 670. At step 670, the pump remains off until manually switched on.

FIG. 9 is an overview of the system of FIG. 5. As shown in FIG. 9, the system according to a preferred embodiment can include a supply reservoir 501 which can be a tank, spring, pond, well, other water source, or the like, a pump 522, solar arrays 530, a check valve 578, a pressure sensing device 525, float level-controlled storage vessels 516, and a storage tank 505. FIG. 9 also shows the direction of fluid flow F through a piping distribution circuit 580.

Figure 10:
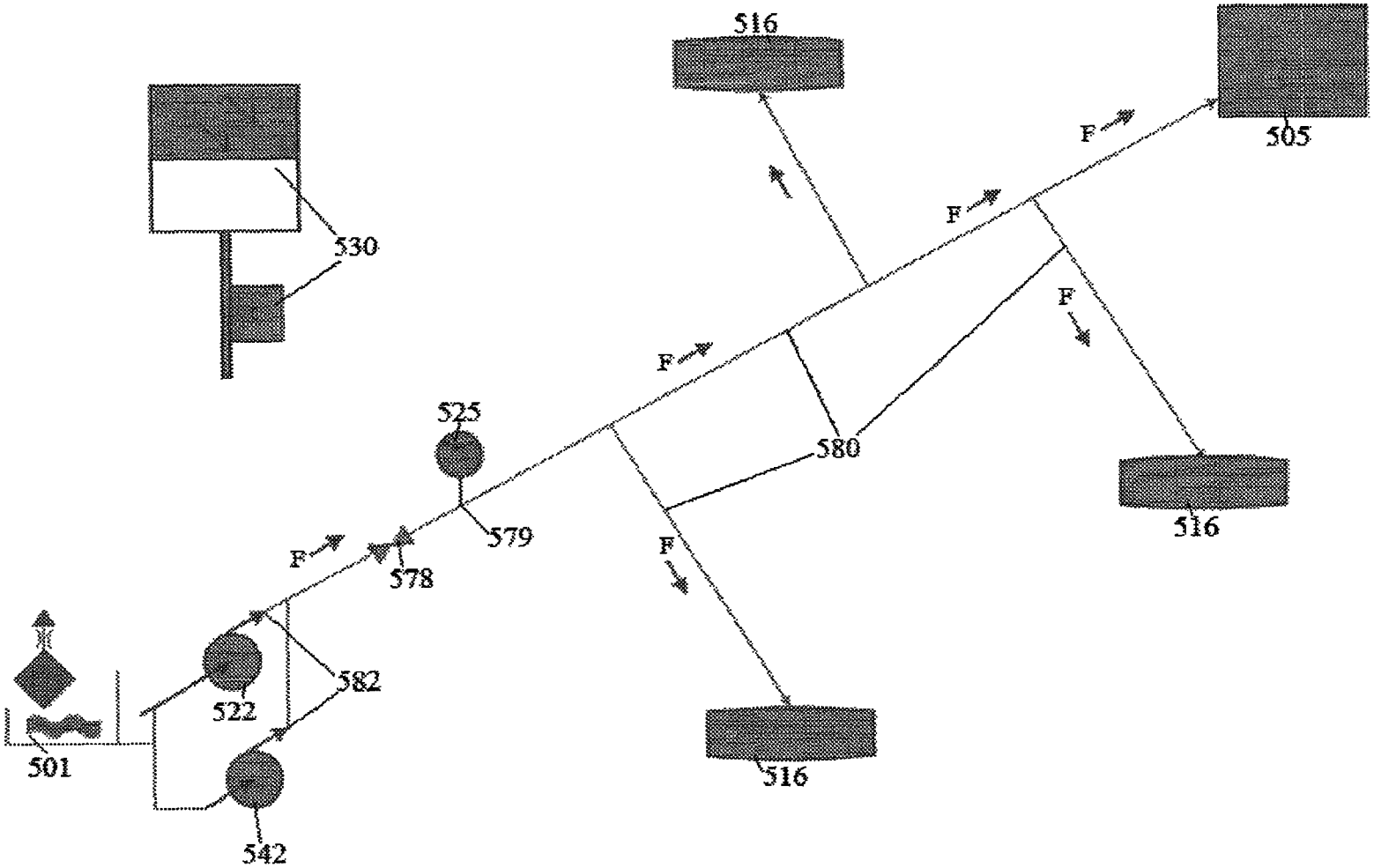
FIG. 10 is an alternative embodiment which includes at least two pumps.

FIG. 10 is an alternative embodiment which includes at least two pumps. As shown in FIG. 10, the system can include a main well pump 522 and an auxiliary distribution pump 542. The main well pump 522 can be powered by a power source 511, which can be, for example, a propane fueled generator. The auxiliary distribution pump 542 can be powered by a power source 511, which can be, for example, a solar power source, which can include one or more solar arrays 530. The auxiliary pump may tap into a water source, including a water source that does not include a well pump. As such, aspects of this embodiment may be particularly suitable for a reservoir with no well pump or for an older well with a storage tank that is close to the well head. In other words, in such an embodiment, the system can be used with any water source.

It will be appreciated by those skilled in the art that the present invention is not restricted to the particular preferred embodiments described with reference to the drawings, and that variations may be made therein without departing from the scope of the present invention as defined in the appended claims and equivalents thereof. As such, aspects of one or more embodiments may be used in conjunction with aspects of other embodiments to create new embodiments without departing from the scope of this disclosure.

What is claimed is:

1. A pump and control system for distributing a fluid from a source location to one or more remote locations wherein at least one of the remote locations is at an elevation higher than that of the source location, the system comprising:

a power source;

a controller;

a plurality of fluid storage vessels at the one or more remote locations;

distribution piping;

one or more monitoring devices to sense fluid pressure corresponding to fluid fill levels in one or more of the plurality of fluid storage vessels; and a pump that automatically provides fluid to the plurality of fluid storage vessels at the remote locations through the distribution piping, wherein the distribution piping comprises a piping circuit connected to a highest elevation fluid storage vessel of the plurality of fluid storage vessels in the piping circuit such that a pressure change can be observed throughout the piping circuit as fluid level in said highest elevation fluid storage vessel changes, and wherein the distribution piping includes additional piping that connects one or more lower elevation storage vessels of the plurality of fluid storage vessels to the highest elevation storage vessel such that fluid flows from the highest elevation storage vessel to the one or more lower elevation storage vessels.

2. The system of claim 1, wherein the fluid is water and the one or more monitoring devices include one or more water pressure sensing devices.

3. The system of claim 2, wherein the one or more water pressure sensing devices includes one or more switches or pressure transducers for detecting pressure in the distribution piping.

4. The system of claim 1, wherein the one or more monitoring devices relay the pressure in the distribution piping to the controller and the controller starts the pump when the pressure reaches a preset low level.

5. The system of claim 4, wherein the controller can turn on the pump for a preset pump time in response to a continuous pressure measurement beyond a preset pressure set point by the pressure sensing device for a preset elapse time.

6. The system of claim 4, wherein the controller causes the pump to stop after a predetermined amount of time after the starting of the pump.

7. The system of claim 1, wherein the one or more monitoring devices includes at least one of one or more float switches or one or more pressure switches or one or more pressure transducers for monitoring one or more fluid levels in the one or more fluid storage vessels.

8. The system of claim 1, wherein the power source includes one or more solar arrays.

9. The system of claim 8, wherein the one or more solar arrays includes at least two arrays.

10. The system of claim 9, wherein one of the at least two arrays powers the pump and another one of the at least two arrays powers the controller.

11. The system of claim 9, wherein one of the at least two arrays is larger than another one of the at least two arrays.

12. The system of claim 1, wherein the controller includes multiple operating modes and a mode selector switch operable to select an automatic, off, or manual mode.

13. The system of claim 1, wherein the fluid is water.

14. The system of claim 1, further comprising:

an auxiliary pump.

15. The system of claim 14, wherein the pump is powered by a propane generator.

16. The system of claim 15, wherein the auxiliary pump is powered by one or more solar arrays.

17. The system of claim 1, further comprising:

a check valve.

18. The system of claim 17, wherein the check valve is connected to a tee, and wherein the monitoring device is connected to the tee.

19. The system of claim 1, wherein the source location and at least one of the one or more remote locations are separated by at least one mile.

20. The system of claim 1, further comprising one or more lower elevation storage vessels suitable for watering livestock, wherein piping connects said one or more lower elevation storage vessels to the highest elevation storage vessel such that fluid flow from the highest elevation storage vessel to the one or more lower elevation storage vessels occurs without need of a pump.

21. The system of claim 1, wherein at least one monitoring device of the one or more monitoring devices senses fluid pressure corresponding to fluid fill levels in the highest elevation fluid storage vessel.

22. A pump and control system for distributing a fluid from a source location to one or more remote locations wherein at least one of the remote locations is at an elevation higher than that of the source location, the system comprising:

a power source;

a controller;

a plurality of fluid storage vessels at the one or more remote locations;

distribution piping in communication with one or more of the plurality of fluid storage vessels, wherein the distribution piping includes piping that connects one or more lower elevation storage vessels of the plurality of fluid storage vessels to a highest elevation storage vessel of the plurality of fluid storage vessels and facilitates fluid flow from the highest elevation storage vessel to the one or more lower elevation storage vessels;

one or more pressure sensing devices to sense fluid pressure corresponding to fluid fill levels in one or more of the plurality of fluid storage vessels; and a pump that automatically provides fluid to one or more of the plurality of fluid storage vessels at the remote locations through the distribution piping, wherein one or more monitoring devices monitor one or more of a flow rate of the pump and operating conditions of the generator; wherein the controller automatically monitors the power source and the pump to protect against operation under low flow conditions or operation of the power source or pump during unsuitable operating parameters; and wherein, when the system shuts down, the system provides a troubleshooting message indicating any reasons for shutdown.

* * * * *